United States Patent [19]

Leubner et al.

[11] Patent Number: 4,902,611

[45] Date of Patent: Feb. 20, 1990

[54] PREPARATION OF SILVER HALIDE EMULSIONS CONTAINING IRIDIUM

[76] Inventors: Ingo H. Leubner; Weimer W. White, both of Eastman Kodak Co., Rochester, N.Y. 14650

[21] Appl. No.: 294,035

[22] Filed: Jan. 6, 1989

[51] Int. Cl.[4] ..... G03C 1/06

[52] U.S. Cl. ..... 430/567; 430/569; 430/605

[58] Field of Search ..... 430/567, 605, 569

[56] References Cited

U.S. PATENT DOCUMENTS

| | | | |
|---|---|---|---|
| T962,004 | 9/1977 | Dostes et al. | 430/605 |
| 2,448,060 | 8/1948 | Smith et al. | 430/605 |
| 2,566,245 | 8/1951 | Trivelli et al. | 430/608 |
| 2,566,263 | 8/1951 | Trivelli et al. | 430/448 |
| 2,717,833 | 9/1955 | Wark | 430/605 |
| 3,367,778 | 2/1968 | Berriman | 430/411 |
| 3,531,291 | 9/1970 | Bacon | 430/605 |
| 3,615,579 | 10/1971 | Bigelow | 430/569 |
| 3,960,549 | 6/1976 | MacGregor | 75/108 |
| 3,979,207 | 9/1976 | MacGregor | 75/121 |
| 3,979,213 | 9/1976 | Gilman | 430/570 |
| 4,693,965 | 9/1987 | Ihama et al. | 430/569 |

OTHER PUBLICATIONS

Research Disclosure No. 26253, May 1986, Kenneth Mason Publications, Ltd., The Old Harbourmaster's, 8 North Street, Emsworth, Hampshire P010 7DD, England.

B. H. Carroll, "Iridium Sensitization: A Review," Photographic Science and Engineering, 24: 265–267, 1980.

*Primary Examiner*—Paul R. Michl
*Assistant Examiner*—Janet C. Baxter

[57] ABSTRACT

Improved reproducibility is obtained when silver halide emulsions containing iridium are prepared using a nitric acid solution of an iridium (IV) salt.

11 Claims, No Drawings

PREPARATION OF SILVER HALIDE EMULSIONS CONTAINING IRIDIUM

This invention relates to the preparation of silver halide emulsions. In a particular aspect it relates to preparation of such emulsions containing iridium by using as the source of iridium a nitric acid solution of an iridium salt. In another aspect, it relates to emulsions prepared by this process.

Since the middle 1940's, iridium has been described as an addendum to silver halide emulsions to modify their photographic properties. Smith and Trivelli, in U.S. Pat. Nos. 2,448,060, 2,566,245, and 2,566,263 describe the use of salts of Group VIII metals, including iridium, to increase the sensitivity of a silver halide emulsion. The '060 and '245 patents describe the use of tetravalent metal salts while the '263 patent describes the use of the trivalent metal salt.

Wark U.S. Pat. No. 2,717,833; Berriman U.S. Pat. No. 3,367,778; Bacon U.S. Pat. No. 3,531,291 and Bigelow U.S. Pat. No. 3,615,579 describe the use of iridium salts in the preparation of light-developable silver halide emulsions and direct positive silver halide emulsions.

Gilman et al U.S. Pat. No. 3,979,213 describes the use of iridium as a metal dopant in internal image silver halide emulsions.

*Research Disclosure,* May 1986, Item 26253, describes the use of iridium salts in combination with sulphur sensitizers in the preparation of silver halide emulsions. *Research Disclosure* is published by Kenneth Mason Publications, Ltd., The Old Harbourmaster's, 8 North Street, Emsworth, Hampshire P010 7DD, England.

Defensive Publication T962,004, published Sept. 6, 1977, describes the use of iridium salts with water soluble purine bases or salts.

Ihama et al U.S. Pat. No. 4,693,965 issued Sept. 15, 1987, describes ripening of a silver halide emulsion in the presence of an iridium salt and a photographic spectral sensitizing dye.

A review of the various ways in which iridium has been used in the preparation of silver halide emulsions is contained in B. H. Carroll "Iridium Sensitization: A Review", Photographic Science and Engineering, 24: 265–267, 1980.

The literature to date, when discussing iridium salts, equates salts of iridium (III) and iridium (IV), and describes their incorportion into the silver halide emulsion from aqueous solutions.

For preparation of small batches of emulsion, that do not require a long period of time, the solution stability of the iridium salt is not of concern. However, in a manufacturing environment, it often is necessary to keep a solution for several hours during the preparation of an emulsion. It then is desirable that the solution be as stable as possible, so as to minimize variations in the composition of the solution from the start of the preparation to the end of the preparation which might result in differences in performance of the emulsion made at the beginning of the preparation and those made at the end.

Accordingly, it would be desirable to provide processes of preparing silver halide emulsions containing iridium, in which the iridium salt solution is relatively stable.

We have found that improvements in the solution stability of iridium salts can be obtained if the salt is the iridium (IV) salt in an aqueous nitric acid solution.

Thus, in accordance with one aspect of our invention there is provided a process for preparing silver halide emulsions containing iridium by treating the emulsion, during or after precipitation of the silver halide grains, with an aqueous solution of an iridium salt, wherein the iridium salt solution is a nitric acid solution of an iridium (IV) salt. In accordance with another aspect of this invention, there are provided emulsions prepared by this process.

As the iridium salt there can be used any of the iridium (IV) salts and complexes available in the art to modify the properties of silver halide emulsions. Iridium halides, alkali metal iridium halides, alkaline earth metal iridium halides, ammonium iridium halides and alkyl- and aryl-ammonium iridium halides are suitable. In a preferred embodiment, the iridium salt is dipotassium hexachloroiridate (IV).

The iridium salt can be present in the solution in a concentration of 0.01 to 20 grams/liter, depending upon the purpose and manner of addition to the silver halide emulsion.

Preferably, the solution is from 0.01 to 10.0 Normal in nitric acid. Especially preferred are 0.1 to 5.0 Normal nitric acid solutions. Most preferred are 1.0 to 4.0 Normal nitric acid solutions.

The solution should be free of species which tend to destabilize the iridium (IV) salt. Such species are reducing agents, such as halides, and weak oxidizing agents, such as potassium nitrate.

The iridium (IV) salts, and their nitric acid solutions can be prepared from commercially available trivalent iridium salts by oxidizing with nitric acid. The resulting nitric acid solution can be used as is, or the iridium (IV) salt can be separated by precipitation and redissolved in an aqueous nitric acid solution. Methods for purification of iridium salts are described in MacGregor U.S. Pat. Nos. 3,960,549 and 3,979,207; and a typical preparation of a solution useful in the practice of this invention is shown in Example 1, infra.

The iridium salt solutions employed in this invention can be used to modify the properties of silver halide emulsions in the ways and for the purposes that iridium salt solutions have been used in the prior art. Thus, the iridium salt solution can be added to the emulsion during precipitation of the emulsion to include iridium in the silver halide grain, or it can be added after precipitation of the emulsion to add iridium to the surface of the grain. Iridium can be used to increase the sensitivity of the emulsion, to improve or modify its development characteristics, to reduce reciprocity failure, to impart internal sensitivity, to stabilize it against fog, and/or to decrease its sensitivity to physical manipulation.

Depending on the purpose for which the iridium salt is added to the emulsion, it can be present in amounts from $10^{-8}$ to $10^{-1}$ mols iridium per mol silver.

In addition, the emulsion can be chemically and/or spectrally sensitized prior to, at the same time as, or subsequent to addition of iridium.

In a preferred embodiment, the iridium salt solution is employed with negative-working silver bromide and silver chloride emulsions, or combinations thereof with each other and/or with silver iodide.

In a particularly preferred embodiment, the iridium salt is used to increase the sensitivity of the silver halide grains by adding iridium to the emulsion subsequent to precipitation and/or to decrease reciprocity failure by incorporation during precipitation. Especially preferred is use of iridium in combination with a chemical sensitizer, such as sulfur, noble metals, e.g. gold, and combinations thereof and/or a spectral sensitizer such as cyanine or merocyane dye.

The emulsions prepared in accordance with this invention can be used in the ways that such emulsions have previously been used in the art. Representative uses include color photographic elements, including color negative and color reversal films and papers, and in black-and-white elements such as X-ray and lithographic films and papers. Details of such use are described in *Research Disclosure* December 1978, Item 17643, pp 21–31; *Research Disclosure* August 1979, Item 18434, pp 433–441; and *Research Diclosure* November 1979, Item 18716, pp 647–651.

The following examples further illustrate this invention.

EXAMPLE 1

Synthesis of Dipotassium Hexachloroiridate, $K_2IrCl_6$ mw=483.2

Tripotassium hexachloroiridate, $K_2IrCl_6$, (150 gm, 0.24 moles) was dissolved in distilled water (2 l). In succession, concentrated hydrochloric acid (300 ml) and nitric acid (200 ml) were added to the solution. The resulting solution was heated slowly to 90° C. and then allowed to stand until it had cooled to room temperature. Potassium chloride (298 gm) was added to the solution, followed by the addition of sufficient distilled water to bring the total volum to 3.5 l. Stirring was continued until all potassium chloride had dissolved. After chilling to 10° C. during which time the product precipitated from solution, the suspension was filtered through a coarse glass filter by suction filtration. The product was washed on the funnel, first by a chilled (10° C.) solution of potassium chloride (31 gm in 475 ml water) and then with ethanol (500 ml). The product was dried at 105° C. A yield of 113.5 gm was obtained, which was 82% of the theoretically possible yield.

EXAMPLE 2

Solution Stabilities of Potassium Hexachloroiridate for Solutions

The Table 1, below, contains a summary of the solution stabilities of the title salt. Comparisons were made in distilled water, aqueous nitric acid of varying normality, aqueous potassium nitrate, and aqueous solutions of mixtures of sodium chloride and sodium bromide. The table illustrates that the aqueous nitric acid solution is by far the most stable. Stability is expressed as the time required for 5% of the iridium (IV) salt to decompose to other species as measured by a 5% decrease in the absorption spectra attributed to the iridium (IV) salt.

TABLE 1

Stability of $K_2IrCl_6$ in Aqueous Solutions

| | Conc. | Solution Composition | Temp. (°C.) | Stability (5% Decomposition) |
|---|---|---|---|---|
| Control | — | Distilled Water | 30 | 36 minutes |
| 1. Invention | 0.1 N | $HNO_3$ | 30 | 18 hours |
| 2. Invention | 0.1 N | $HNO_3$ | 70 | 29 minutes |
| 3. Invention | 1.0 N | $HNO_3$ | 30 | >23 days |
| 4. Invention | 4.0 N | $HNO_3$ | 30 | >4 months |
| 5. Comparison | 2.0 N | $KNO_3$ | 30 | 16 minutes |
| 6. Comparison | 2.0 N<br>0.1 N | $KNO_3$ +<br>$HNO_3$ | 30 | 14 minutes |
| 7. Comparison | 1.5 N<br>0.1 N | NaCl/Br (mol ratio 15:85)<br>+$HNO_3$ | 30 | 1.2 minutes |

Samples 1, 3 and 4 show that nitric acid solutions of the iridium salt have significantly increase stability compared to a control from which the nitric acid was omitted or a comparison, sample 5, with potassium nitrate. Comparison samples 6 and 7 illustrate the effect of destabilizing species such as potassium nitrate and sodium halides.

This invention has been described in detail with reference to preferred embodiments thereof. However, it will be appreciated that the variations can be employed without departing from the spirit of the invention.

What is claimed is:

1. A process for preparing a silver halides emulsion by treating the emulsion, during or after precipitation of silver halide grains, with an aqueous solution of an iridium salt, wherein the iridium salt solution is a nitric acid solution of an iridium (IV) salt.

2. A process of claim 1, wherein the iridium salt is dipotassium hexachloroiridate (IV).

3. A process of claim 1, wherein the iridium salt is present in a concentration of 0.01 to 20 grams/liter.

4. A process of claim 1, wherein the nitric acid solution is from 0.01 Normal to 10.0 Normal.

5. A process of claim 4 wherein the solution is from 1.0 Normal to 4.0 Normal.

6. A process of claim 1 in which the silver halide emulsion is silver chloride, silver bromide, or mixtures thereof with each other and/or with silver iodide.

7. A process of claim 6 wherein the emulsion is a negative-working silver chloride or silver chlorobromide emulsion.

8. A process of claim 6 wherein the emulsion is a negative-working silver bromide or silver bromoiodide emulsion.

9. A photographic element containing a silver halide emulsion prepared according to a process of any one of claims 1 through 8.

10. A photographic element of claim 9, wherein the silver halide emulsion is chemically and spectrally sensitized.

11. A photographic element of claim 10, wherein the iridium is present in the silver halide grains in a concentration of $10^{-8}$ to $10^{-1}$ moles iridium per mole silver.

* * * * *

UNITED STATES PATENT AND TRADEMARK OFFICE

CERTIFICATE OF CORRECTION

PATENT NO. : 4,902,611

DATED : February 20, 1990

INVENTOR(S) : Leubner et al

It is certified that error appears in the above-identified patent and that said Letters Patent is hereby corrected as shown below:

On the title page Item [76] Inventors: "Weimer W. White" should be --Weimar W. White--.

Signed and Sealed this

Seventh Day of April, 1992

*Attest:*

*Attesting Officer*

HARRY F. MANBECK, JR.

*Commissioner of Patents and Trademarks*